US005464220A

United States Patent [19]

Hansen et al.

[11] Patent Number: 5,464,220

[45] Date of Patent: Nov. 7, 1995

[54] GOLF PRACTICE DEVICE AND METHOD

[76] Inventors: Dale G. Hansen, 7276 Rezen St., Rockford, Mich. 49341; Donald C. Wohlin, 5610 Chauncey, NE., Belmont, Mich. 49306

[21] Appl. No.: 347,271

[22] Filed: Nov. 30, 1994

[51] Int. Cl.[6] ..... A63B 69/36

[52] U.S. Cl. ..... 273/186.1; 273/187 R; 273/35 A; 273/187.6

[58] Field of Search ..... 273/187 R, 187 A, 273/187 B, 187.1, 187.6, 186.1, 35 A, 192

[56] References Cited

U.S. PATENT DOCUMENTS

| | | | |
|---|---|---|---|
| 1,208,995 | 12/1916 | Lyon | 273/187 R |
| 1,781,230 | 11/1930 | Hill | 273/187 R |
| 2,025,519 | 12/1935 | Lingg | 273/187 R |
| 2,169,407 | 8/1939 | Crowley | 273/187 R |
| 3,229,981 | 1/1966 | Taber | 273/187 R |
| 4,423,875 | 1/1984 | Miller | 273/192 X |
| 4,538,815 | 9/1985 | Poirier | 273/187 R |
| 4,718,674 | 1/1988 | Henry | 273/187 R X |
| 4,736,952 | 4/1988 | Taft et al. | 273/187 R X |
| 4,784,393 | 11/1988 | Williams et al. | 273/187 R |
| 4,871,175 | 10/1989 | Levin et al. | 273/187 R |
| 5,013,044 | 5/1991 | Hesselbart | 273/191 R X |
| 5,060,952 | 10/1991 | Brill | 273/192 X |
| 5,083,789 | 1/1992 | Hickson | 273/187 R |
| 5,108,106 | 4/1992 | Cook | 273/187 R |
| 5,110,132 | 5/1992 | Weston et al. | 273/187 R |
| 5,246,234 | 9/1993 | Zambelli | 273/187 R |
| 5,255,921 | 10/1993 | Spence | 273/187 A |
| 5,350,177 | 9/1994 | Furbush | 273/192 X |

FOREIGN PATENT DOCUMENTS

| | | | |
|---|---|---|---|
| 17666 | 10/1916 | United Kingdom | 273/187 R |
| 2100607 | 6/1981 | United Kingdom | 273/187 R |
| 2254008 | 3/1992 | United Kingdom | 273/187 R |

OTHER PUBLICATIONS

"VuSwing®—A Reflection of Your Progress" by Mike Jamison, date unknown, publisher unknown.

*Primary Examiner*—George J. Marlo

*Attorney, Agent, or Firm*—Price, Heneveld, Cooper, DeWitt & Litton

[57] ABSTRACT

A golf practice device includes a first strip having indicia for indicating proper positioning of a golfer's feet, a second strip having a marker for indicating a proper ball position, and third and fourth strips pivotally interconnecting the first and second strips to form an adjustable parallelogram. A template is attached to the first and second strips at the corner between the two for indicating the angle therebetween. The template includes indicia for indicating predetermined angles corresponding to particular golf clubs so that, by arranging the strips to form a particular predetermined angle, the correct golf stance and ball placement is indicated for a selected golf club. The spacing between the first and second strips is adjustable to allow for different sized golfers. In one form, an adjustable and customizable template is provided. Also, optionally, a mirror and a back swing clicker are provided for improved feedback to a golfer using the device.

27 Claims, 3 Drawing Sheets

GOLF PRACTICE DEVICE AND METHOD

BACKGROUND OF THE INVENTION

The present invention concerns golf teaching devices, and more particularly concerns a golf teaching device adapted to improve a golfer's stance and also provide accurate ball placement for different golf clubs, thus allowing the golfer to concentrate on the golfer's swing.

Golf is a deceptively complex game. Because of this, it is important for novice golfers to learn a proper golf stance including placement of the golf ball and a proper golf swing so that consistently successful golf shots can be made. Also, it is important for more experienced golfers to periodically "return to the basics" or otherwise refine their game. There are numerous golf training devices that attempt to improve a golfer's game by, among other things, improving a golfer's stance and the placement of a golf ball relative to the stance. These devices attempt to reduce the variables of alignment and ball placement, thus allowing the golfer to concentrate on his/her swing. However, many of these devices are cumbersome to set up and/or use, awkward to adjust, and/or difficult to carry. Further, many of these devices do not work, or distract the golfer such that it is difficult for the golfer to concentrate on his/her swing. For example, some devices in effect capture one or both of a golfer's feet such that the golfer cannot move in a natural manner without fear of stepping on the device. This causes the golfer to focus on avoiding the device, rather than on his/her swing. Other devices include vertically extending posts and the like that get in the way and make the device cumbersome to set up and use. Also, some of these devices are unsightly, and can be embarrassing for a golfer to use. Still other devices provide a complex adjustment mechanism that either takes a long time to adjust, is subject to error, or that requires a more complex adjustment procedure than most golfers are willing to make.

Another problem with known golf training devices is that they cannot be easily customized on site for a particular golfer's size or preferences, or for a golf professional's preferences. For example, young golfers are typically much shorter and have shorter golf clubs than adult golfers, and thus their stance and ball placement must change accordingly. However, known devices are only marked with indicia for an "average sized" golfer to avoid becoming cluttered with markings. The same cluttered appearance and complexity occurs if known devices are marked to incorporate different theories concerning ball positioning. Specifically, one theory often used by golfing professionals is to position a golf ball progressively rearwardly from the front of a golfer's stance as the golfer progresses from a driver (e.g. a one "wood" golf club) to a short iron (e.g. a nine iron or pitching wedge golf club). In a second theory, the golf ball is positioned in a single forward position for "wood" golf clubs and in a single second position for all "iron" golf clubs. Other theories concerning ball placement also exist. For example, the forwardmost position of the ball may vary from one theory to another. Known golf teaching devices are not adapted to allow on-site customization to accommodate each of these different theories and preferences.

U.S. Pat. No. 5,110,132 discloses an alignment apparatus for golfers wherein four links are interconnected to position a golfer from a golf ball and to provide feedback to the golfer regarding the position of his golf club during his swing. However, the device basically depends on the golfer to properly orient himself or herself to the target and to correctly position his or her feet relative to the ball, both of which are often part of a golfer's problem. Still further, the apparatus is not adapted to position a ball properly for different clubs, nor for golfers that are physically different in size. Neither can the apparatus be easily customized on-site.

Great Britain Foreign Patent GB 2,100,607 discloses a golf stance device that includes a front bar (1) for positioning a golfer's feet, and a ball locating pointer (4) for indicating proper ball position for different golf clubs. Notably, the device includes an arm (2), one end of which extends between the golfer's feet to a position where it can be stepped on. This may adversely affect the golfer's concentration, as discussed above. Also, the arms (5 and 6) are shown as being only a few inches long, and thus they are too short to give a proper ball position. For example, the ball pointing tip on arm (4) moves over-center and toward the golfer when pivoted from the three wood golf club position to the driver golf club position. No known theory concerning ball placement moves a ball position in that manner. Thus, the ball positions in FIG. 1 of Great Britain '607 must vary significantly from the end of arm (4), and a golfer using this apparatus is left to guess how far off the end of the arm (4) to place the ball. Notably, ann (2) cannot be relocated to solve this problem since it must be located adjacent the inside heel of the golfer's left foot. Also, it is noted that longer pivot arms (5 and 6) do not solve this problem since the pointed end of arm (4) continues to move in an arc that does not correlate well to proper ball placement. Still further, the markings on arm (1) are adapted for only an average size golfer, and are not adapted for use by each of several different sized golfers. Also, the markings are not adapted for easy on-site customization.

Great Britain Foreign Patent GB 2,254,008 discloses a golf training aid including four interconnected members and a fifth elongated member for indicating ball position. The device requires that the fifth member be repeated disconnected, repositioned and reconnected by pins to accurately locate the ball fore-to-aft relative to the golfer's stance for different clubs, and that the one interconnected member closest to the golfer's feet also be repeatedly disconnected, repositioned and reconnected by pins to accurately position the golfer from the ball. This double repositioning and also the existence of a separate fifth member add undesirable complexity to the golfing device. Further, a set of holes (16) must be formed in the front and rear members for each different size golfer, which holes (16) make on-site customization of the device difficult.

Thus, a golf teaching device is desired solving the aforementioned problems.

SUMMARY OF THE INVENTION

The present invention includes a golf practice device including a first strip having indicia for indicating proper positioning of a golfer's feet, a second strip parallel the first strip having a marker for indicating a proper ball position, and third and fourth strips pivotally interconnecting the first and second strips to thus form an adjustable parallelogram. A template is attached to one of the strips at a corner of the parallelogram for indicating the angle between the one strip and an adjacent of the strips. The template includes indicia defining a plurality of predetermined corner angles corresponding to a plurality of different golf clubs. By arranging the strips to form a selected one of the predetermined angles, the correct golf stance and ball placement is indicated for a selected golf club.

The illustrated preferred embodiment of the present invention includes several advantages over known prior art devices. The present device is very easy to use, and can be "set up" by simply laying it on the ground with a long leg of the parallelogram pointing at the target and with the proper golf club selection being indicated on the corner template. To adjust the present device for a different golf club, the ball positioning leg of the parallelogram is simply moved arcuately to a new position. The accuracy of alignment is maintained since the foot position indicating leg of the parallelogram does not need to be moved. To adjust the present device to a shorter golfer, the "ends" of the parallelogram are shortened based on indicia calibrated to compensate for height. Further, the present device can be easily customized to accommodate different theories of ball placement by either replacing the template, by rotating a "four quadrant" template to show different sets of indicia calibrated for a selected ball placement pattern, or by marking the template with a customized novel pattern.

These and other features, advantages and objects of the present invention will be further understood and appreciated by those skilled in the art by reference to the following specification claims and appended drawings.

DETAILED DESCRIPTION OF PREFERRED EMBODIMENT

Figure 1:
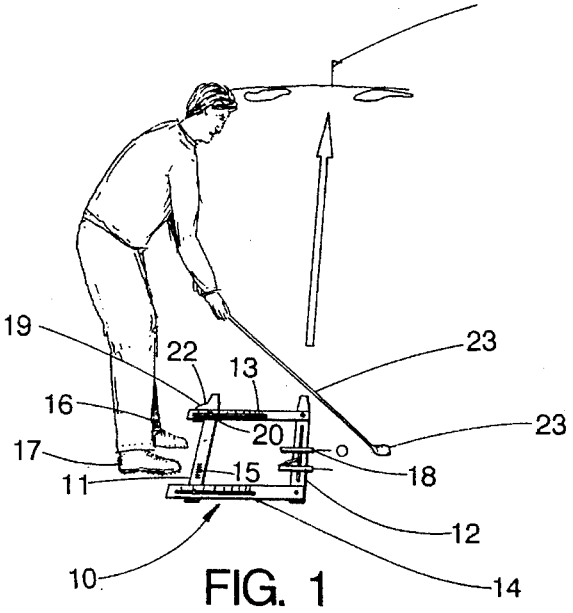
FIG. 1 is a perspective view of the golf teaching apparatus including a golfer using same embodying the present invention.
Figure 2:
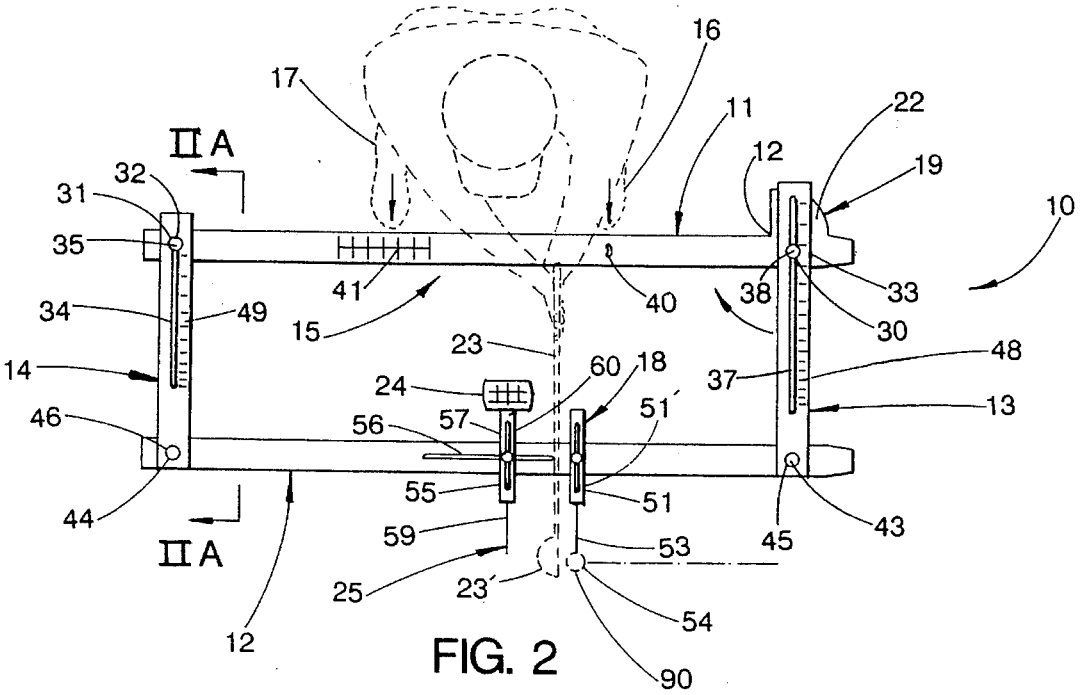
FIG. 2 is a plan view of the golf teaching apparatus as shown in FIG. 1.
Figure 3:
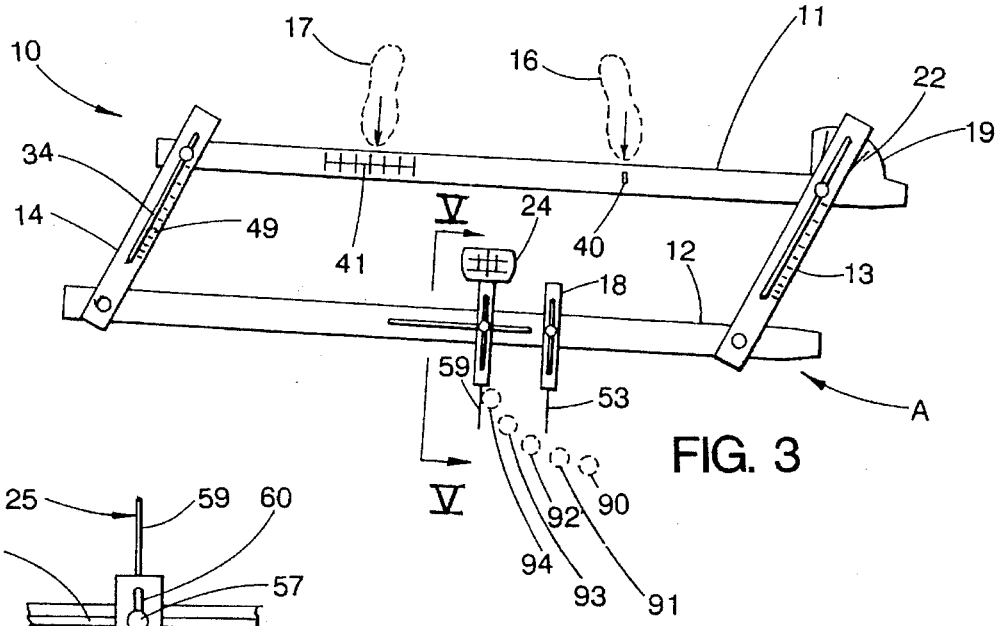
FIG. 3 is a plan view of the golfing apparatus shown in FIG. 2, the golfing apparatus being adjusted for use with a three iron.

A golf practice device 10 (FIG. 1) embodying the present invention includes a first strip or elongated member 11 having indicia 15 for indicating proper positioning of a golfer's feet 16 and 17, and a second strip or elongated member 12 parallel the first strip 11 and having a marker 18 for indicating a proper golf ball position. Both the first and second strips 11 and 12 help align the device with a target 8. Third and fourth strips 13 and 14 pivotally interconnect the first and second strips 11 and 12 to form an adjustable parallelogram such that preferred ball position 90–94 are indicated as the parallelogram is adjusted along direction "A" (FIG. 3). A template 19 is attached to the first strip 11 at corner 20 for indicating angles between the two strips 11 and 13. The template 19 includes indicia 22 for indicating predetermined corner angles calibrated to selected golf clubs 23 so that, by arranging the strips 11 and 13 to form a particular predetermined corner angle, the correct golf stance and ball placement is indicated by the strips 11 and 12 for the selected golf club. The spacing between the first and second strips 11 and 12 is adjustable to allow for different sized golfers. Further, a mirror 24 (FIG. 2) and also a back swing indicator 25 are available for improved feedback to a golfer using the device.

More specifically, strips 11, 12, 13 and 14 are made of a damage resistant material such as polycarbonate thermoplastic, and have a cross-sectional dimension of about 2 inches×¼ inches. Also, strips 11 and 12 are optimally about 44 inches long, and strips 13 and 14 are optimally about 22 inches long. However, it is contemplated that alternative cross-sectional shapes, lengths and materials can also be satisfactorily used. Notably, foot positioning strips 11–14 can be inverted or reversed for use by a left handed golfer, in which case the indicia 15 for positioning a golfer's feet and also the template indicia 22 must be marked on both sides of the strip 11 and template 19, respectively.

Figure 2A:
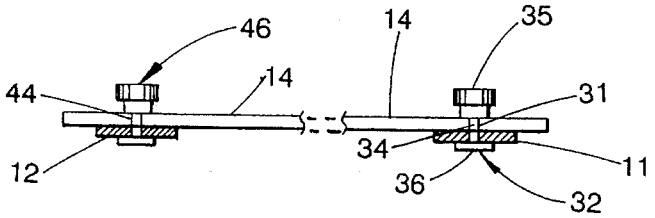
FIG. 2A is a sectional view on line IIA—IIA in FIG. 2, the apparatus being laid out for use with a driver.

Strip 11 (FIGS. 2 and 2A) includes holes 30 and 31 at each end of strip 11 for receiving threaded pivot bolts 32 and 33. Strip 14 includes a slot 34 for slideably receiving the shaft of pivot bolt 32. A threaded knob 35 (FIG. 2A) engages pivot bolt 32, and can be rotated by hand to clamp the strips 11 and 13 together against the head 36 of pivot bolt 32. Similarly, strip 13 includes a slot 37 for slideably receiving a shaft of pivot bolt 33. A threaded knob 38 engages pivot bolt 33, and can be rotated to clamp the strips 11 and 14 together against the head of the pivot bolt 33.

Indicia 15 (FIG. 2) is located on strip 11 for indicating the proper position of a golfer's feet. Indicia 15 includes a front mark 40 for indicating the position of a golfer's left foot. A scale 41 is spaced from front mark 40 for indicating the proper position of a golfer's right foot in units of inches from front mark 40. Different scales can be used, however, the width between a golfer's shoulders is recognized as being related to a proper stance width. Accordingly, the optimal scale 41 indicates the golfer's right foot position relative to the golfer's left foot position in inches. Thus, the golfer can then position his/her feet based on his/her shoulder width.

Figure 7:
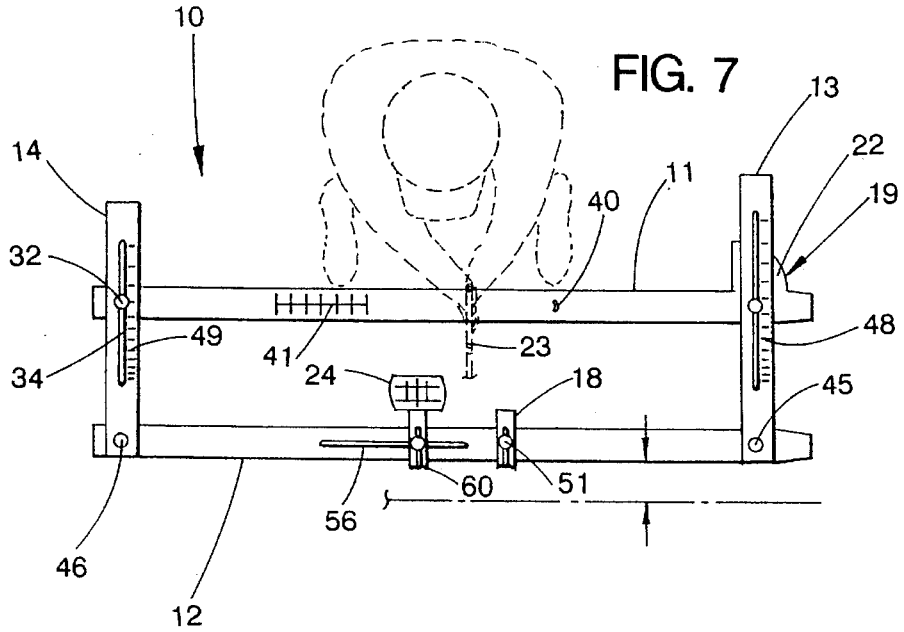
FIG. 7 is a plan view of the golf teaching apparatus as shown in FIG. 2, the golf teaching apparatus being adjusted to accommodate a younger, shorter golfer.

Strips 13 and 14 (FIG. 2) include holes 43 and 44, respectively, for pivotally securing strip 12 to strip 11 to form an adjustable parallelogram. In particular, strip 12 includes holes at each end that correspond to holes 43 and 44, and clamps 45 and 46 are extended through holes 43 and 44, respectively, to clamp strip 12 to strips 13 and 14, respectively. Clamps 45 and 46 include a bolt and threaded knob comparable to pivot bolt and threaded knob 35. Slots 34 and 37 extend longitudinally in strips 13 and 14 such that, by adjusting strips 13 and 14 on pivot bolts 32 and 33, respectively, ball positioning strip 12 can be adjusted toward and away from foot positioning strip 11 to control the spacing therebetween. Indicia 48 and 49 are located along slots 34 and 37, respectively. Indicia 48 and 49 are non-uniformly graduated scales chosen to reflect the desired distance between strip 11 and strip 12 for golfers having different heights. Testing has shown that the graduated scales need to be more compressed as strip 12 is located more and more closely to strip 11. For shorter golfers, strip 12 is positioned closer to strip 11 than for taller golfers (see FIG. 7). This adjustment automatically moves the indicated ball positions 90, 91, 92, 93 and 94 (FIG. 3) indicated by ball marker 18 closer to the golfer (see FIG. 3). Strip 12 is intended to be kept continuously parallel strip 11, however, it is noted that by adjusting strips 13 and 14 to unequal lengths, a quadrilateral shape can be made for teaching a golf swing and stance for slicing or hooking a golf ball.

Figure 6:
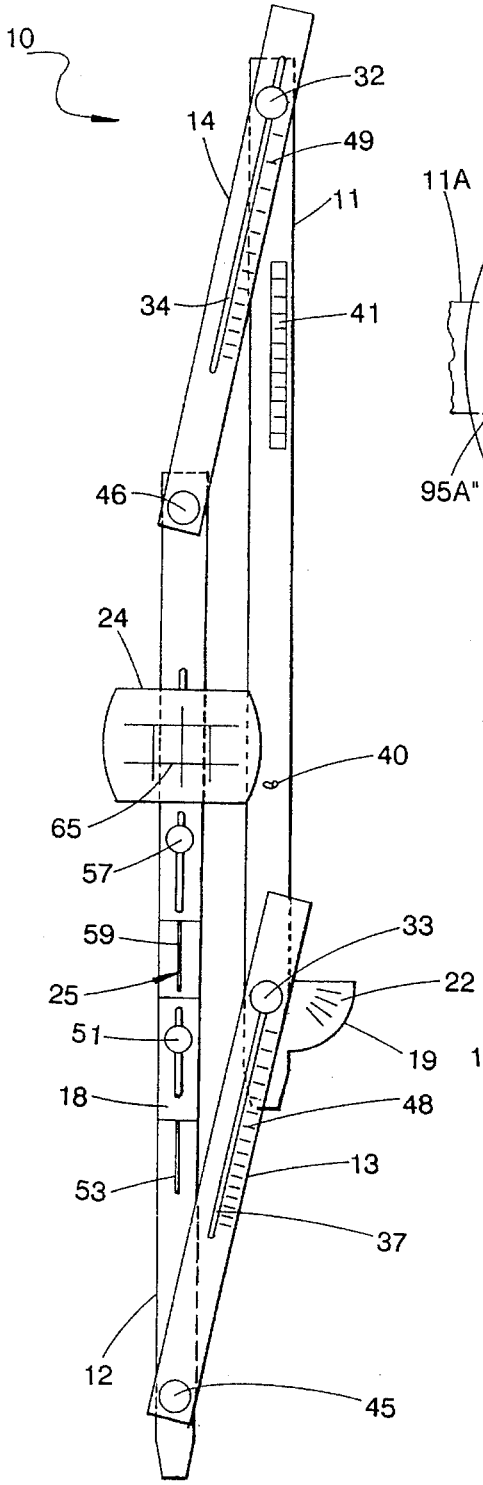
FIG. 6 is a plan view of the golf teaching apparatus adjusted to a storage position.
Figure 9:
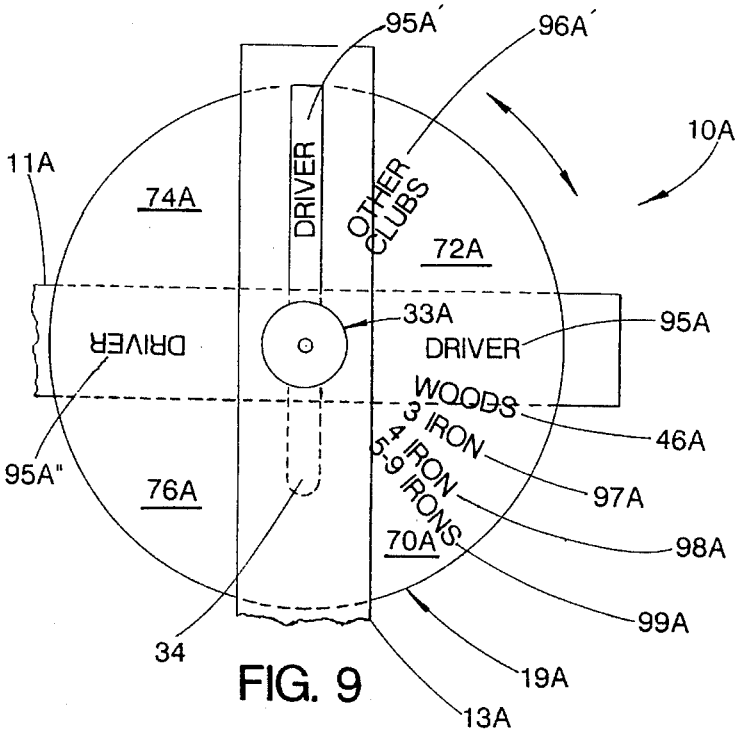
FIG. 9 is an enlarged fragmentary plan view of an alternative embodiment of the golf teaching apparatus.

Strip 12 (FIG. 2) includes a hole, and ball marker 18 is pivotally connected to strip 12 at the hole by clamp 51. Clamp 51 includes a pivot bolt and a threaded knob comparable to pivot bolt 32 and threaded knob 35. This allows ball marker 18 to be pivotally moved to a storage position aligned with strip 12 (FIG. 6). There are a pair of spaced perpendicular lines 51' on strip 12 (FIG. 2) for accurately locating ball marker 18 perpendicularly on strip 12 when device 10 is to be used. Ball marker 18 includes a short strip 52, and a resiliently flexible straw-like finger 53 that extends axially from an end of ball marker 18. A golf ball 54 is positioned off the end of finger 53 but proximate finger 53 so that the ball placement is very accurate and repeatable. By rotating strip 12 about strip 11 (i.e. by rotating strips 13 and 14), the finger 53 moves in an arcuate pattern (FIG. 3). By selecting a particular angle on template 19, as discussed below, ball positions 90–94 are accurately and repeatably identified. Notably, if strip 12 is positioned closer to strip 11 such as for a shorter golfer (i.e. the effective length of strip 13 and 14 are adjusted to a shorter length), the arcuate pattern changes to a smaller radius arc and the rearward movement of the ball position relative to the golfer's stance is also reduced.

Back swing indicator 25 (FIG. 2) includes a short strip 55, and is pivotally secured in a slot 56 in strip 12 by clamp 57. Clamp 57 includes a pivot bolt and a threaded knob comparable to pivot bolt 32 and threaded knob 35. A resilient straw-like finger 59 extends from the end of strip 55. Back swing indicator 25 can be adjusted so that the finger 59 clicks against the head 23' of golf club 23 during the back swing of the club 23. This causes the golfer to draw the club head 23' rearwardly along a preferred path during the back swing and reduces the tendency of the golfer to undesirably lift the club head 23' during the initial part of the back swing. Short strip 55 also includes a slot 60. By adjusting back swing indicator 25 angularly on clamp 57 and by adjusting clamp 57 along slots 56 and 60, the location of the end of finger 59 can be adjusted to an infinite number of locations relative to ball marker 18.

Figure 4:
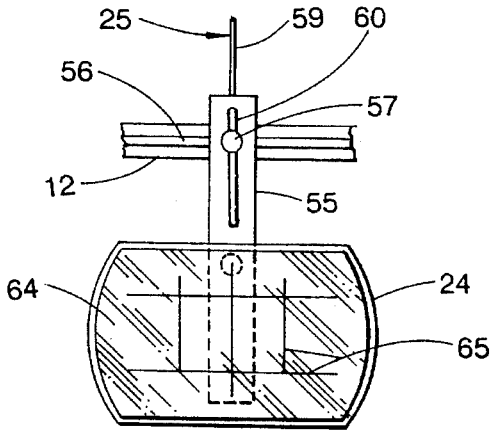
FIG. 4 is a plan view of the mirror accessory shown in FIG. 2.
Figure 5:
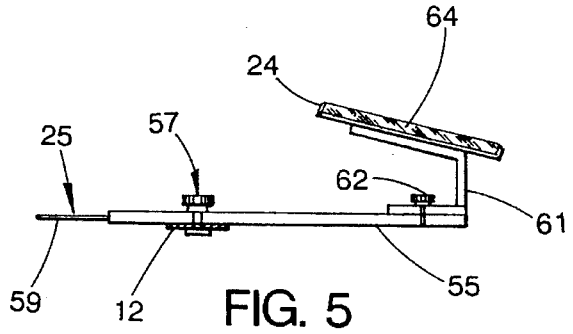
FIG. 5 is a side view of the mirror accessory shown in FIG. 4.

Mirror 24 (FIGS. 4–5) is mounted on short strip 55 by a C-shaped mirror bracket 61 (FIG. 5) that spaces mirror 24 above strip 12. A threaded bolt 62 including an enlarged head secures C-shaped mirror bracket 61 in place. Mirror 24 includes a reflective surface 64 (FIG. 4) that is convexly-shaped so that the golfer can view his or her swing. A checker board pattern of lines 65 are placed on reflective surface 64 to help provide alignment feedback to the golfer on club and stance alignment when addressing the golf ball as well as during the back swing, the ball striking portion of the swing, and the follow through portion of the golf swing. Notably, back swing indicator 25 and mirror 24 are optional accessories. When a back swing indicator 25 and a mirror 24 are included, it is contemplated that a box-like carrying case (not specifically shown) will also be provided, although the device 10 can also be carried in a golf bag when pivoted to the folded storage position (FIG. 6).

Figure 8:
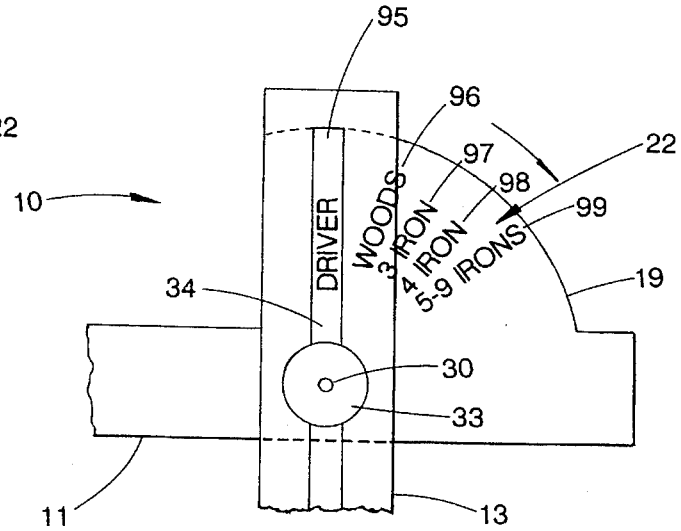
FIG. 8 is an enlarged fragmentary plan view of a corner of the golf teaching apparatus shown in FIG. 2.

The indicia 22 of template 19 (FIG. 8) includes markings 95–99 located at predetermined angles about hole 30 and pivot bolt 33. As the strips (11–14) of the adjustable parallelogram are adjusted angularly, the slot 34 will align with various ones of markings 95–99. The indicia 95–99 are selectively positioned on template 19 so that the proper position of ball marker 18 will be located in ball positions 90–94 (FIG. 3) when the respective indicia 95–99 (FIG. 8) align with slot 34. Thus, by swinging strip 12 about strip 11 along path A, different clubs can be selected and a ball can be properly positioned.

Notably, not all theories or strategies regarding relative ball position to a golfer's stance are the same, and further different golfers prefer different ball placements. For this reason, an instructor's golf teaching device 10A is provided that is adapted for to accommodate different theories and that is customizable. When discussing golf teaching device 10A, comparable or identical features that are the same for golf device 10 are identified with identical numbers but with the addition of the letter "A". The instructor's golf teaching device 10A includes strips substantially identical to strips 11–14 of device 10, except as noted below. In device 10A, the template (19) has been replaced with a circled-shaped template 19A located between strips 11A and 13A that is rotatably supported on pivot bolt 33A. Template 19A is divided into four equal quadrants, each quadrant including indicia to accommodate different theories concerning ball placement. More specifically, quadrant 70A includes indicia 90A–94A comparable to indicia 90–94 noted above. Quadrant 72A includes only indicia 95A' and 96A', 95A' being the location for striking a driver golf club and location 96A' being the ball location for using non-driver golf clubs. Quadrant 74A includes only indicia 95A", with all clubs being hit from the same spot. Notably, in quadrant 74A, indicia 95A" is located slightly rearwardly from the comparable position 95A on quadrant 74A. Quadrant 76A is unmarked, but can be marked with a crayon or otherwise scribed with customized indicia tailored to a particular golfer's preferences or physical features, or a golf professional's preferences. By rotating template 19A, various ball placement patterns can be selected. Operation of golf teaching device 10A is achieved by selecting the desired quadrant 70A, 72A, 74A or 76A and orienting the selected quadrant in a use position on the device 10A. Thereafter, the adjustable parallelogram is angularly adjusted as previously described.

Thus, a golf practice device including four pivotally interconnected strips forming an adjustable parallelogram is provided, one of the strips providing foot positioning indicia and an opposite strip providing ball positioning indicia. A template located at the corner of the adjustable parallelogram provides markings for indicating the correct angular position of the adjustable parallelogram such that the optimal ball position is accurately indicated relative to the stance and the stance is squarely located relative to a given target.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A golf practice device, comprising:

a first strip having indicia for indicating proper positioning of a golfer's feet;

a second strip spaced from and parallel to said first strip and having a ball marker for indicating a proper ball position;

a third strip pivotally intercomnecting said first and second strips, and a fourth strip spaced from said third strip also pivotally interconnecting said first and second strips, said first, second, third and fourth strips forming a pivotally adjustable parallelogram; and a template attached to one of said strips at a corner defined between said one strip and an adjacent of said strips, said template including indicia defining a plurality of predetermined corner angles corresponding to a plurality of golf clubs, whereby, by arranging said strips to a selected one of said predetermined corner angles on said template, the correct golf stance and ball placement is indicated for a selected golf club.

2. A golf practice device as defined in claim 1 wherein said template is located at a corner defined by said first and second strips.

3. A golf practice device as defined in claim 2 wherein said template is attached to said first strip.

4. A golf practice device as defined in claim 1 wherein said template is removably secured to said one strip.

5. A golf practice device as defined in claim 1 wherein said template is rotatably attached to said one strip.

6. A golf practice device as defined in claim 1 wherein said third and fourth strips include slots and said first and third strips include clamps engaging said slots and configured such that said first and second strips can be adjusted closer together and farther apart.

7. A golf practice device as defined in claim 6 including indicia on said third and fourth strips to indicate relative spacing between said first and second strips.

8. A golf practice device as defined in claim 7 wherein said indicia on said third and fourth strips correlates to the shoulder width of a golfer.

9. A golf practice device as defined in claim 7 wherein said indicia on said third and fourth strips correlates to the spacing between a golfer's feet as indicated by the indicia on said first strip.

10. A golf practice device as defined in claim 1 wherein said indicia on said first strip includes marks approximately equal to the width of different golfer's shoulders.

11. A golf practice device as defined in claim 1 including a mirror attached to one of said strips for providing feedback to the golfer during the golfer's golf swing.

12. A golf practice device as defined in claim 1 wherein said ball marker is adjustably secured to said second strip for movement in a direction toward and away from said first strip.

13. A golf practice device as defined in claim 1 including a back swing clicker attached to one of said strips for indicating a proper back swing by the golfer.

14. A golf practice device as defined in claim 1 including clamps for clamping said first, second, third and fourth strips together to frictionally secure said strips in a given configuration, said clamps including a knob that can be manually rotated to tighten said clamp.

15. A golf practice as defined in claim 1 wherein said mirror is spaced generally above said second strip and includes a bracket for securing said mirror to one of said strips.

16. A golf practice device, comprising:

a foot positioning member including a first elongated member with indicia thereon far indicating proper positioning of a golfer's feet;

a ball positioning member attached to said foot positioning member including a second elongated member pivotally connected to said first elongated member and forming a corner defining an angle with said first elongated member, said angle being variable as said second elongated member is pivotally moved relative to said first elongated member, said ball positioning member further including a ball marker operably attached to said second elongated member for indicating the proper location of a golf ball for a selected golf club; and a template attached to said first and second elongated members at said comer and having indicia thereon for indicating angles defined by said first and second elongated members, selected of said angles corresponding to selected golf clubs so that a correct ball position is indicated by said ball positioning member for a particular selected golf club when said first and second elongated members are set at a corresponding particular selected angle.

17. A golf practice device as defined in claim 16 including third and fourth elongated members pivotally attached to said first elongated member and said second elongated member, respectively, to form a geometric quadrilateral shape.

18. A golf practice device as defined in claim 17 wherein said first, second, third and fourth elongated members define an angularly adjustable parallelogram.

19. A golf practice device as defined in claim 16 wherein said template is removably secured to said first and second elongated members.

20. A golf practice device as defined in claim 19 wherein said template is rotatable and includes quadrants having indicia thereon incorporating different ball placement strategies.

21. A golf practice device as defined in claim 16 wherein said indicia for indicating proper positioning of a golfer's feet includes a first mark for indicating a golfer's front foot and a scale for indicating the position of the golfer's rear foot based on the golfer's shoulder width.

22. A golf practice device as defined in claim 16 including a mirror attached to said ball positioning member.

23. A golf practice device as defined in claim 16 including a back swing clicker for providing feedback to the golfer concerning a desired path of the golf club during the back swing by the golfer.

24. A golf practice device as defined in claim 16 including clamps for releasably securing said first and second elongated members in a given angular arrangement.

25. A method comprising steps of:

providing a teaching device having first, second, third and fourth elongated members pivotally interconnected to form an adjustable parallelogram with said first and second elongated members being continuously parallel and spaced apart, said first elongated member including indicia for positioning a golfer's feet for a particular golf club, said second elongated member including a ball marker for indicating proper golf ball placement relative to the golfer's feet, said teaching device further including an angle indicating template attached to one of said elongated members an end thereof for indicating predetermined angles between said one elongated member and an adjacent of said elongated members, said predetermined angles corresponding to selected golf clubs;

angularly adjusting said elongated members to form a first parallelogram having a first predetermined angle at said end so that said indicia for positioning a golfer's feet and said ball marker are accurately positioned for a first selected golf club; and angularly adjusting said second elongated member relative to said first elongated member to form a second parallelogram having a second predetermined angle at said end so that said indicia for positioning a golfer's feet and said ball marker are accurately positioned for a second selected golf club, said first and second predetermined angles being different.

26. A method as defined in claim 25 wherein said steps of adjusting include swinging said second elongated member along an arcuate path defined by said third and fourth members while maintaining said second member parallel said first member.

27. A method as defined in claim 25 including a step of adjusting the spacing between said first and second elongated members based on a golfer's height.

* * * * *

UNITED STATES PATENT AND TRADEMARK OFFICE

CERTIFICATE OF CORRECTION

PATENT NO. : 5,464,220
DATED : November 7, 1995
INVENTORS : Dale G. Hansen et al.

It is certified that error appears in the above-identified patent and that said Letters Patent is hereby corrected as shown below:

Column 2, line 23;
"ann" should be --arm--.

Column 3, line 64;
"position" should be --positions--.

Column 4, line 4;
"comer" should be --corner--.

Column 4, line 51;
After "bolt" insert --32--.

Column 7, line 57;
"thereon far" should be --thereon for--.

Column 8, line 4;
"comer" should be --corner--.

Column 8, line 51;
After "members" insert --at--.

Signed and Sealed this

Eighteenth Day of June, 1996

Bruce Lehman

*Attest:*

BRUCE LEHMAN

*Attesting Officer*

*Commissioner of Patents and Trademarks*